US006393626B1

(12) United States Patent
Dhillon

(10) Patent No.: US 6,393,626 B1
(45) Date of Patent: May 28, 2002

(54) DUAL-ACTING PLUNGER

(76) Inventor: Sunny S. Dhillon, 1005 Brentwood La., Wheaton, IL (US) 60187

( * ) Notice: Subject to any disclaimer, the term of this patent is extended or adjusted under 35 U.S.C. 154(b) by 0 days.

(21) Appl. No.: 09/957,772

(22) Filed: Sep. 21, 2001

(51) Int. Cl.[7] ..... E03D 11/00
(52) U.S. Cl. ..... 4/255.12; 4/255.01; 4/255.11
(58) Field of Search ..... 4/255.05, 255.06, 4/255.01–255.04, 255.12, 255.11

(56) References Cited

U.S. PATENT DOCUMENTS

| | | | | | |
|---|---|---|---|---|---|
| 1,769,061 | A | * | 7/1930 | Hitchcock | 222/3 |
| 1,972,114 | A | | 9/1934 | Stephenson | 4/255 |
| 2,368,091 | A | * | 1/1945 | Andersen | 417/480 |
| 2,496,525 | A | | 2/1950 | Eggleston | 4/255 |
| 2,498,359 | A | | 2/1950 | Coleman | 4/255 |
| 3,062,152 | A | | 11/1962 | Huff, Sr. | 103/148 |
| 3,195,328 | A | | 7/1965 | Mantell | 68/43 |
| 4,320,539 | A | | 3/1982 | Li | 4/256 |
| 4,445,236 | A | | 5/1984 | Nadolny et al. | 4/255 |
| 4,674,137 | A | * | 6/1987 | Girse | 4/255 |
| 4,745,641 | A | | 5/1988 | Tash | 4/255 |
| 4,768,237 | A | | 9/1988 | Torti | 4/256 |
| 5,249,311 | A | | 10/1993 | Rau | 4/255.05 |

FOREIGN PATENT DOCUMENTS

| | | | |
|---|---|---|---|
| CA | 484028 | 6/1952 | |
| IT | 471149 | * 12/1952 | 4/255.1 |

* cited by examiner

*Primary Examiner*—Gregory L. Huson
*Assistant Examiner*—Huyen Le
(74) *Attorney, Agent, or Firm*—Welsh & Katz, Ltd.; Eric D. Cohen, Esq.

(57) ABSTRACT

A plunger device for unblocking a clogged drain or pipe, comprises a valve housing interposed between a handle and a suction cup; a valve seat having an opening for communicating the cup with the housing; a fluid outlet formed in the housing to provide a fluid path to the outside of the device; a valve ball positioned in the housing to close said opening of the valve seat and said fluid outlet when said ball is positioned on the seat, a bolt moveable in said housing to abut said ball for locking the ball between the bolt and said seat, thereby causing fluid under pressure to flow in one direction-into the clogged drain, the bolt being movable away from said ball to unlock the ball and open said fluid outlet, said ball moving freely inside the valve housing when said ball is unlocked, thereby enabling fluid to flow in the opposite direction only—out from the clogged drain; and switch means associated with the bolt and lock and unlock the valve ball when clearing the clogged drain.

13 Claims, 3 Drawing Sheets

DUAL-ACTING PLUNGER

BACKGROUND OF THE INVENTION

This invention relates generally to a plunger device for clearing a clogged drain or pipe; and more specifically relates to a plunger device that has the option for generating a fluid pushing force under pressure to flow into the drain, or for generating a fluid pulling force under pressure to flow out from the drain and into the cup only.

The conventional plunger device includes an elongated handle connected to a flexible hollow cup having an open bottom end defined by a circular lip. To properly use such known plungers, the handle is positioned so that only a portion of the lip of the cup initially contacts the surface surrounding the clogged drain at a suitable angle, about 45 degrees. The handle is then pushed downward to distort and collapse and reduce the size of the partially seated cup and thereafter moving the plunger handle in an arc so that the entire lip of the collapsed cup is in contact with the drain surface to create a seal of the lip of the cup with the drain surface. The handle is then pulled upward (or outward) to expand and straighten the cup and return the cup to its original shape. This causes fluid under pressure (suction) to rush outwardly from the clogged drain pipe and into the expanded cup, due to the vacuum created in the cup. This loosens and breaks apart the clogged impurities by inducing a force in the fluid of the drain such that the fluid attacks the clog from the opposite direction of drainage. This direction offers to break the clog from the opposite direction that it was formed, where it is weakest. This action often unseats the cup from the surface. The process is usually repeated in quick cycles order to sufficiently break apart the impurities clogging the drain and causing the blockage. The cycles must be rapid such that the fluid lifted from the drain should not to flow back into the drain by the onset of the next cycle. Utilizing the conventional plunger in this method is physically challenging, requires greater effort, and is unreliable at best.

A problem with the use of conventional plunger devices in the method of reorienting the plunger handle is that frequent sealing and distorting of the shape of the cup caused appreciable leakage of the forced fluid, thus decreasing and reducing the quantity of forced fluid available to act upon and free the clogged materials inside the drain pipe.

Moreover, the users of the known plungers often do not properly seal the lip of the cup to the surface around the inlet to the clogged pipe due to the range of motion involved for this method. Hence, a proper vacuum was not achieved for pulling the clogged material out from the drain pipe.

Another problem with the known plungers was that the fluid under pressure streamed inside the clogged drain when the handle was pushed inward for compressing the cup. At times it is necessary to induce force into the drain in attempt to move a clog free further into the drain. But, this often causes the clogged material to tighten and compact inside the drain pipe or the clogged material was pushed further inside the pipe, making it more difficult to free the clogged pipe. Thus, the operation of the known plungers was often counter-productive.

Canadian Patent No. 484,028, dated Jun. 17, 1952, entitled "Drain Opening Apparatus" to P. Larue discloses a manually operable plunger device having a ball positioned inside a hollow head, forming a valve. The valve seat has an open condition when the ball is spaced upward from the seat to permit fluid flow into the atmosphere, and a closed condition when the ball is seated on the seat to close or block any flow into the atmosphere.

After the cup is compressed or pressed flat and the valve ball is repositioned on the seat and the ball closes air flow out into the atmosphere. Upon raising or straightening the shape of the cup to increase the volume of the cup, a vacuum is created inside the cup and fluids inside the drain rush to fill the vacuum; and causes the valve ball to move upward and open the pathway to the outside.

The valve ball in the Larue device, however, cannot be locked in place on the valve seat when the user of the device is reducing the volume of the cup for providing a pushing force into the drain to clean the clogged drain because the valve ball is free floating.

SUMMARY OF INVENTION

In accordance with an embodiment of the invention, a lockable plunger apparatus is disclosed for clearing clogged material from the inside of a drain pipe of a sink, tube or like having a fluid inlet surrounded by a surface. The apparatus includes a handle, an inverted cup, a valve housing connected between the handle and the cup, a valve seat having an opening for communicating the inside of the cup with the housing via the fluid outlet, and a valve ball positioned in the housing for opening and closing the opening of the valve seat. The opening is closed to prevent fluid from flowing to the outside when the ball is spaced from the valve seat, and a moveable bolt in the housing abuts the ball to lock the ball on the valve seat to close the opening.

The valve switches from a normally closed position to an open position in response to fluid under pressure generated when the cup is compressed or flattened, to provide a fluid pathway from the cup to the outside of the apparatus. Thus, when the valve is in the open position, the fluid flow is diverted away from the clogged drain pipe.

The valve is maintained closed in response to fluid under pressure flowing from the inside the clogged drain to the inside of the cup when the cup is caused to expand and thereby return to its original or normal shape.

At least one fluid outlet is formed in the housing of the valve to provide a passage to the outside when the valve is open. The fluid pathway to the aperture is closed when the valve is in the closed position.

In one embodiment, the plunger for clearing clogging material from a drainage pipe includes a flexible, hollow inverted cup having an open end for contacting a contact surface of a drainage pipe. The cup forms a cup chamber therewithin. An elongated handle is operatively coupled to the cup and is configured to transmit force to the cup to cause the cup to distort. The plunger includes a valve housing assembly operatively disposed between the cup and the handle, where the valve housing assembly includes a pathway within the valve assembly configured to permit fluid communication between the cup chamber and an external environment. A valve is disposed within the pathway for blocking the pathway. A valve position controller is configured to releasably retain the valve in a blocking position to block the pathway to prevent the fluid communication such that when the controller retains the valve in the blocking position, application of downward force on the handle creates a fluid flow under pressure from the cup chamber into the fluid inlet. When the controller does not retain the valve in the blocking position, application of downward force on the handle permits fluid flow from the cup chamber to the external environment, while application of upward force on the handle creates a fluid flow under suction from the fluid inlet into the cup chamber.

BRIEF DESCRIPTION OF THE DRAWINGS

The features of the present invention which are believed to be novel are set forth with particularity in the appended claims. The invention, together with further objects and advantages thereof, may best be understood by reference to the following description in conjunction with the accompanying drawings.

DETAILED DESCRIPTION

In this written description, the use of the disjunctive is intended to include the conjunctive. The use of definite or indefinite articles in not intended to indicate cardinality. In particular, a reference to "the" object or thing or "an" object or "a" thing is intended to also describe a plurality of such objects or things.

It is to be further understood that the title of this section of the specification, namely, "Detailed Description of the Invention" relates to Rules of the U.S. Patent and Trademark Office, and is not intended to, does not imply, nor should be inferred to limit the subject matter disclosed herein or the scope of the invention.

Figure 1:
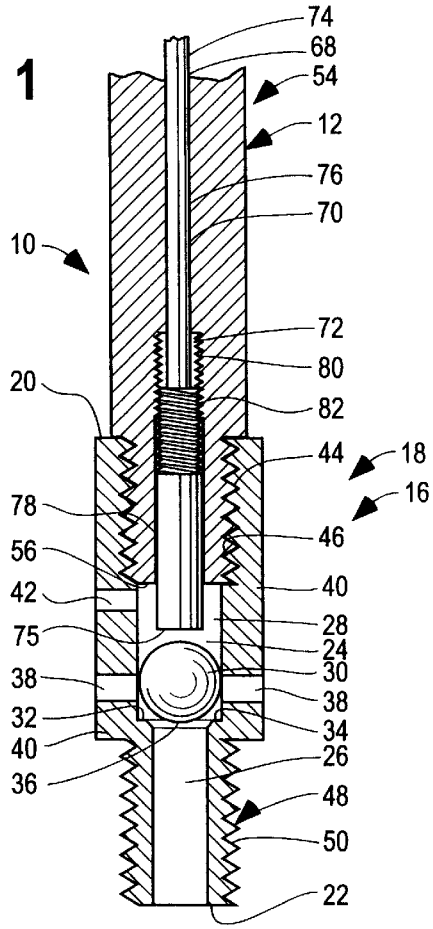
FIG. 1 is an enlarged sectional view of the coupling for connecting the handle with the flexible inverted cup, to illustrate the operation of the fluid valve of a specific embodiment of the plunger device.

Referring now to FIGS. 1 though 6 and 12 of the drawings, the reference numeral 10 indicates a plunger device generally. The plunger device 10 includes an elongated handle 12, a flexible, inverted cup 14, and a fluid control valve 16 interposed between the handle 12 and the cup 14.

The fluid control valve 16 includes a valve main housing 18 having an upper end 20 and a lower end 22. A fluid pathway 24 extends centrally in the main housing 18 for discharging fluid to the outside.

The valve main housing 18 includes a tubular fluid inlet chamber 26 and a cylindrical fluid discharge chamber 28. A valve ball 30 is positioned inside the discharge chamber 28. The cross sectional area perpendicular to the longitudinal axis of the main housing 18 for the fluid discharge chamber 28 is greater than the cross sectional area for the fluid inlet chamber 26.

The fluid control valve 16 further includes a valve seat 32 formed between the inlet fluid chamber 26 and the discharge fluid chamber 28. The valve seat 32 includes an outer ring or ledge 34 encircling an aperture 36 disposed between the inlet chamber 26 and the discharge chamber 28. The aperture 36 communicates with the inlet chamber 26 and the discharge chamber 28. The aperture 36 is covered or blocked when the valve ball 30 is seated on the valve seat 32. Hence, the fluid control valve 16 includes the aperture 36 having an open position when the valve ball 30 is spaced from the seat 32, and a closed position to block fluid flow to the outside of the device 10 when the ball 30 is seated on the valve seat 32.

The diameter of the valve ball 30 is greater than the diameter of the aperture 36 of the valve seat 32. The ball 30 is seated on the valve seat 32 and the ledge 34 to close the aperture 36 and prevent fluid flow between the inlet chamber 26 and the discharge chamber 28.

One or more spaced apart apertures 38 are formed thorough a cylindrical wall 40 of the discharge chamber 28. The apertures 38 function as fluid discharge outlets to the outside of the plunger device 10 when the valve ball 30 is spaced from the valve seat 32. Fluid flowing from the inlet chamber 26 to the discharge apertures 38 is blocked by the valve ball 30 when the valve ball is restrained/positioned on the seat 32. Moreover, the fluid path to the apertures 38 are closed by the valve ball 30 when the ball is positioned on the seat 32, such as when the ball 30 is restrained by a bolt 74 when the device is used as a conventional plunger.

An orifice 42 is also formed in the wall 40 of the discharge chamber 28, spaced upward from the apertures 38. More than one orifice 42 may be formed in the wall 40. Fluid flows from the outside of the plunger 10 and into the discharge chamber 28 via the orifice 42 when the valve ball 30 is seated so as to maintain the ball 30 on the seat 32.

When the valve ball 30 is spaced upward from the valve seat 32, the fluid pathway 24 is opened to the outside via the apertures 38, and the fluid pathway is closed to the outside when the ball 30 is positioned on the seat 32. The fluid pathway 24 to the outside via the orifice 42 may be blocked by the valve ball 30 when the ball is spaced from the seat 32.

In one embodiment, the valve ball 30 may be replaced by a check-valve, a flapper valve, an umbrella valve and the like, as is known to one skilled in the art.

As may be seen from FIGS. 1 thorough 6 and 12, the upper end 20 of the main housing 18 includes an internal female screw connector 44 formed in the inside surface 46 of the wall 40 of valve housing 18.

The lower end 22 of the valve main housing 18 includes an external, male screw connector 48 formed in the outside surface 50 of the wall 40. The handle 12 includes an upper grip end 54 and a lower end 56. The lower end 56 of the handle 12 includes a male screw connector 57. The female connector 44 formed in the valve main housing 18 at the upper end 20 threadedly engages the male screw connector 57 formed at the lower end 56 of the handle 12.

The cup 14 is formed to a semi-spherical shape, having a hollow inside 58 and a circular bottom rim or lip 60. A body 61 of the cup 14 extends outward from the rim 60 to form a pair of shoulders 62, 63 on opposite sides from a centrally outward protruding neck 64. A channel 66 is formed through the neck 64 for communication with the fluid pathway.

An internal female screw connector 67 is formed inside the channel 66 of neck 64 to threadedly engage the male connector 48.

A central bore 68 is formed inside the handle 12, which extends from the upper end 54 to the lower end 56 thereof. The bore 68 includes an elongated portion 70 and an enlarged portion 72 formed at the lower handle end 56 and in communication with the elongated portion 70. The diameter of the elongated portion 70 of the bore 68 perpendicular to the longitudinal axis of the handle 12 is less than the diameter of the enlarged portion 72, viewed perpendicular to the longitudinal axis of the handle 12.

A long bolt 74 (FIG. 1) is received in the bore 68 for movement therein. The long bolt 74 includes an elongated part 76 and an enlarged part 78. The elongated part 76 of the long bolt 74 moves within the bore 68, and the enlarged part 78 of the long bolt 74 moves within the enlarged portion 72 of the bore 68. The bottom edge 75 of the long bolt 74 may be circular and flat.

As may be seen from FIG. 1, segment 80 of the enlarged portion 72 of the bore 68 is a female threaded connector to receive a complementary male threaded segment 82 of the enlarged part 78 of the moveable long bolt 74. The long bolt 74 of the plunger device 10 is rotated to move vertically for extending into the discharge chamber 28. The bottom edge 75 of the long bolt 74 may abut the valve ball 30 to lock the ball 30 in place. When the ball 30 is sandwiched between the valve seat 32 and the lower or bottom edge 75 of the long bolt 74, and the device 10 functions as a conventional plunger.

When assembling the plunger 10, the long bolt 74 is inserted into the bore 68 of the handle 12 via the lower end 56. The male threaded segment 82 of the long bolt 74 threadedly engages the female complementary segment 80 of the handle 12. The valve ball 30 is inserted through the upper end 20 of the valve main housing 18 and into the fluid outlet chamber 28. Next, the male connector portion 48 on the bottom end 56 of the handle 12 is threadedly engaged into the female portion 44 via the upper end 20 of the main housing 18. Thus, the valve ball 30 is confined between the valve seat 32 and the circular flat end 75 of the long bolt 74. The lower end 22 of the valve main housing 18 is screwed into the neck 64 of the cup 14.

Figure 2:
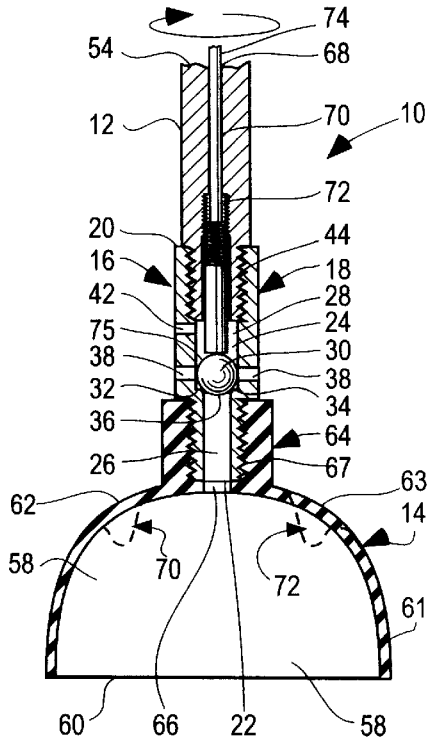
FIG. 2 is a sectional view of the plunger device showing the operation of the device when used as a conventional plunger.

Referring to FIGS. 1 through 6 and 12, the operation of the plunger device 10 will be described. In FIG. 2, the valve ball 30, shown seated and restrained by the long bolt 74, as preset by the user, closes the hole 36 formed within the seat 32 to block flow to the fluid discharge apertures 38, referred to herein as the "set closed position." Accordingly, the plunger 10 functions as a conventional plunger wherein fluid under pressure is forced into the fluid inlet of the clogged drain.

Figure 3:
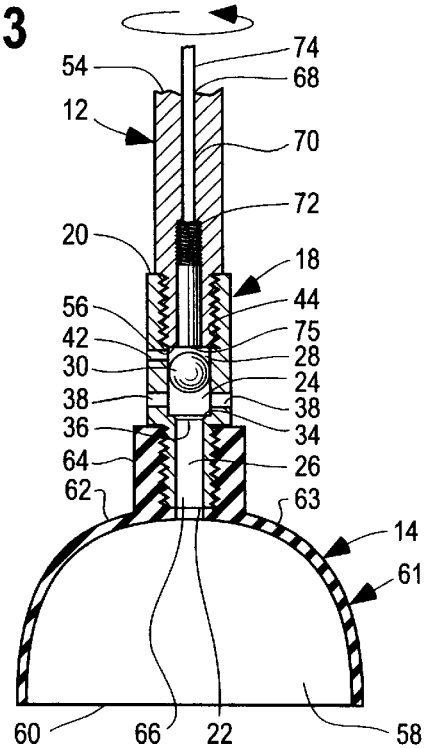
FIG. 3 is a sectional view of the plunger device showing operation of the device when used to generate a vacuum for pulling clogged material outward.
Figure 4:
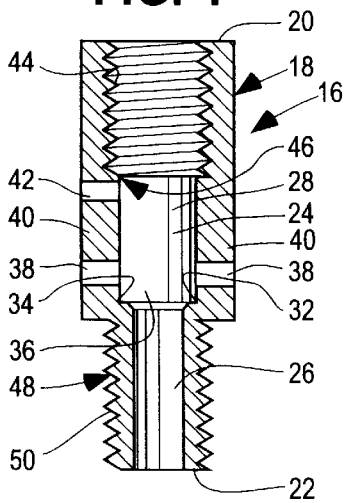
FIG. 4 is a sectional enlarged view of a coupler for connecting the handle to the inverted cup.
Figure 5:
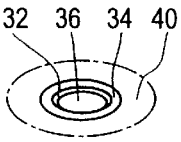
FIG. 5 is a sectional view of the discharge chamber showing the valve seat, viewed on a plane perpendicular to the axis of the housing just below the discharge vents and above the seat, and viewed in the direction from the female threaded end.
Figure 6:
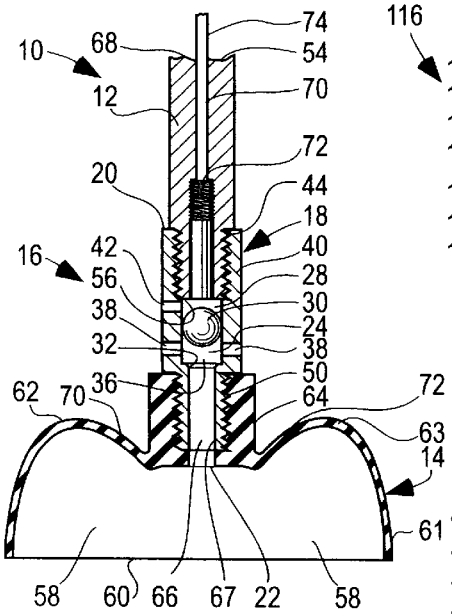
FIG. 6 is a sectional view of the plunger device showing the operation of the device to generate a vacuum for pulling the clogged material outward with the cup in a collapsed state.

In FIG. 3, the valve ball 30 is shown spaced from the seat 32 and also spaced from the fluid discharge apertures 38 due to the user retracting the long bolt 74. This creates a fluid pathway from the inside of the cup 14 to the outside of the plunger 10 via inlet chamber 26, valve hole 36, fluid pathway 24 and discharge apertures 38. This permits the plunger device 10 to vent fluid to the outside via fluid pathway 24 when the user collapses the cup 14. Upon further motion by the user to "un-collapse" the cup 14, the free floating valve ball 30 may relocate to the seat 32 to a closed position and thereby cause fluid under pressure to be forced or pulled out from the clogged drain under suction.

To secure the ball 30 in place, the bottom surface 75 of the long bolt 74 bears against the ball 30 to prevent the ball 30 from slipping or floating away. The long bolt 74 of the plunger device 10 is rotated in one direction, preferably clockwise, to cause the long bolt 74 to move or travel upwardly or downwardly. The long bolt 74 functions as a switch or controller to control the seating or unseating of the ball 30.

The plunger device 10 is placed upright in a sink, tub, toilet or an applicable item thereof, having a clogged pipe. The long bolt 74 is preset by the user and retracted into the handle main housing 12 such that the lower most surface 75 of the long bolt 74 is flush with the bottom of the handle main housing 12. The valve ball 30 is seated by gravity on the seat 32 to close the valve hole 36 and also to close the apertures 38 to prevent fluid flow from the inlet chamber 26 and into the discharge chamber 28. This allows for a temporary closed position (as opposed to the set closed position as defined above) of the fluid valve 16.

The handle 12 is pushed downward to cause the cup 14 to depress and form valley 70 between shoulder 62 and neck 64, and valley 72 between shoulder 63 and neck 64 (shown in phantom in FIG. 2). The depression of the cup 14 distorts the cup 14 and generates fluid under pressure to flow from the hollow inside 58 of the cup 14 and into the inlet chamber 26 of the valve main housing 18. This forces the valve ball 30 off the seat 32 and upward and into contact with the lowermost surface 75 of the long bolt 74. This enables the fluid to flow into the discharge chamber 28 for discharging the fluid to the outside of the plunger device 10 via discharge apertures 38.

Therefore, the fluid under pressure moves the ball 30 off the seat 32, and in effect, switches the valve 16 from a closed position to an open position. The ball is free to move further into the discharge chamber 28 and is not subject to any substantial build up of pressure in the discharge chamber 28 since the upper portion of the discharge chamber 28 consists of a orifice 42, which does not permit any build of pressure in the discharge chamber 28.

After the cup 14 is depressed, a suction is created and the lip 60 of the cup 14 tightly abuts the surface of the sink surrounding the clogged pipe. After the fluid pressure dissipates, the valve ball 30 drifts downward due to gravity to rest on the valve seat 32 and close the hole 36, which also closes the fluid discharge apertures 38.

When the ball 30 closes the valve 16 and the cup 14 is distorted, the handle 12 is pulled upward to return the cup 14 to its original and normal shape. A vacuum is created inside the cup 14, and fluid under pressure rushes from inside the clogged pipe to the inside of the expanded cup 14 to fill the vacuum. Fluid under pressure is also generated inside the discharge chamber 28 which bears against the seated ball 30 to tightly close valve 16. The fluid streaming into the cup from the clogged pipe, suctions the closed material outward and out of the pipe to clear the pipe. The end of this action completes one cycle of operation, and the user will find the device 10 in a temporary closed position with the cup 14 in an un-distorted slope. The firm contact of the lip 60 of the cup 14 with the surface surrounding the inlet into the clogged pipe, would not normally require resetting of the cup 14 after pulling the cup upwardly.

In view of the forgoing, it is seen that a single device 10 provides simple dual directional action to create a unidirectional suction for unblocking a clogged drain pipe. If the clogged pipe is not sufficiently cleared, the user repeats the aforedescribed sequence of pushing and pulling of the fluid in the drain pipe until the pipe is free of the clogging material.

Referring now to FIGS. 6 through 11, 13, 14 of the drawings, an alternate embodiment and its operation is described. Like reference numbers describe like structures. Reference numeral 100 generally indicates a plunger device, embodying the principles of the invention. The plunger device 100 includes an elongated solid handle 106, a flexible, inverted cup 14, and a fluid control valve 116, which is composed of a main housing adapter 103 and a valve housing 18, both interposed between the solid handle 106 and cup 14.

The fluid control valve 116 include a valve housing 18 having an upper end 20 and a lower end 22. A fluid pathway 24 extends centrally in the housing 18, for discharging fluid to the outside.

The valve housing 18 includes a tubular fluid inlet chamber 26 and a cylindrical fluid discharge chamber 28. A valve ball 30 is positioned inside the discharge chamber 28. The cross sectional area perpendicular to the longitudinal center of the housing 18 is greater for the fluid discharge chamber 28 than for the fluid inlet chamber 26.

The valve housing 18 of the fluid control valve 116 further includes a valve seat 32 formed between the inlet fluid chamber 26 and the discharge fluid chamber 28. The valve seat 32 includes an outer ring or ledge 34 encircling and opening 36 between the inlet chamber 26 and the discharge chamber 28. The opening 36 communicates the inlet chamber 26 with the discharge chamber 28. The opening 36 is covered (or closed) when the valve ball 30 is seated on the valve seat 32. Hence, the fluid control valve 116 includes the opening 36 having an open position when the valve ball 30 is spaced from the seat 32, and a closed position to block fluid flow to the outside of the plunger 100 when the ball 30 is seated on the seat 32.

The diameter of the valve ball 30 is greater than the diameter of the opening 36 of the seat 32. The ball 30 is seated on the seat 32 to close the opening 36 of seat 32 and prevent fluid flow between the inlet chamber 26 and the discharge chamber 28.

One or more spaced apart apertures 38 are formed through the cylindrical wall 40 of the discharge chamber 28. The apertures 38 function as fluid discharge outlets to the outside of the plunger device 100 via a path from the inside 58 of the cup 14 to the fluid inlet chamber 26, and out of the discharge apertures 38 when the valve ball 30 is spaced from the valve seat 32. Fluid flowing from the inlet chamber 26 to the discharge apertures 38 is generally blocked by the valve ball 30 when the valve ball 30 is in the restrained/positioned on the seat 32. Moreover, the fluid path to the apertures 38 are closed by the valve ball 30 when the ball is positioned on the seat 32.

An orifice 42 is also formed in the wall 40 of the discharge chamber 28, spaced upward or outward from the apertures 38. More than one orifice 42 may be formed in the wall 40. Fluid flows from the outside of the plunger 100 and into the discharge chamber 28 via the orifice 42 when the valve ball 30 is positioned on the seat 32 to maintain the ball 30 on the seat 32.

The housing adapter 103 connects with the valve housing 18 to enable the plunger device 100 to be used with a pin 118 and bolt 120 arrangement. The housing adapter 103 has an upper end 125 and a lower end 127.

The housing adapter 103 includes a centrally bored bolt sliding cylinder 110 and a pin guide channel 114. The guide channel 114, which is an aperture, provides communication from the outside of the plunger 100 to the bolt cylinder chamber 110. The bolt 120 is positioned inside the bolt sliding cylinder 110. The bolt 120 is secured in place with a pin 118 that is in contact with the bolt 120 via the pin guide channel 114.

The housing adapter 103 further includes a ball upper seat 146, which includes an opening 152 formed between the bolt sliding cylinder 110 and the lower end 127. Upon fluid discharge from the cup 14 to the fluid inlet chamber 24, the re-seated ball 30, positioned at the upper seat 146, blocks flow into the bolt cylinder chamber 110. In effect, the opening 152 is covered (or closed) when the valve ball 30 is seated on the ball upper seat 146 by the fluid pressure.

The diameter of the valve ball 30 is greater than the diameter of the opening 152 of the upper seat 146. The ball 30 is seated on the upper seat 146 to close the opening 152 and prevent fluid flow into the bolt sliding cylinder 110.

The housing adapter 103 (best shown in FIGS. 10, 13, and 14) includes a pin channel guide 114 which includes an upper securing notch 172, a lower securing notch 173, an upper pin containment area 194, a lower pin containment area 196 upper anvil 140 spaced from a lower anvil 141 and linked together by means of the pin guide channel 114.

The cooperation of the pin 118 and bolt 120, as set within the bolt sliding cylinder 110 and the pin channel guide 114, provides a switch for operating either as a single or dual directional plunger device 100.

The pin guide channel 114 is formed through the wall 115 of the housing adapter 103. The pin 118 has a smaller diameter than the pin guide channel 114. The axis of the pin 118 is oriented perpendicular to the pin channel guide 114 and the pin 118 can freely move along an axis parallel to the direction of the pin guide channel 114. The pin 118 has a smaller diameter than the upper containment area 194 and the lower containment area 196 such that the pin can be confined to the area provided. The pin 118 has a larger if not equal diameter to the distance between the upper securing notch 172 and the upper anvil 140 such that the pin stays locked in the upper containment area 194. The pin 118 has a larger if not equal diameter to the distance between the lower securing notch 173 and the lower anvil 141 such that the pin stays locked in the lower containment area 196.

The solid handle 106 includes an upper grip end 154 and a lower end 156. The lower end 156 of the solid handle 106 includes a male screw connector 157 on the solid handle surface 158. The housing adapter 103 includes a female connector 124 at the upper end 125 and a male connector 126 at the lower end 127. The female connector 124 of main housing adaptor 103 engages with the male connector 157 formed in the lower end 156 of the solid handle 106.

The upper end 20 of the main housing 18 includes and internal female screw connector 44 formed in the inside surface 46 of the wall 40 of valve housing 18. The lower end 22 of the main housing 18 includes an external, male screw connector 48 formed in the outside surface 50 of the main housing 18. The female connector 44 at the upper end 20 of the main housing 18 threadedly engaging the male screw connector 126 formed at the lower end 127 of the valve adapter 103.

The cup 14 is formed to a semi-spherical shape, having a hollow inside 58 and a circular bottom rim or lip 60. The body 61 of the cup 14 extends outward from the rim 60 to form a pair of shoulders 62, 63 on opposite sides from a centrally outward protruding neck 64. A channel 66 is formed through the neck 64 for communication the pathway 24 in the housing 18 with the hollow inside 58 of the cup 14. An internal female screw connector 67 is formed inside the channel 66 of the neck 64 to threadedly engage the male connector 48.

Figure 8:
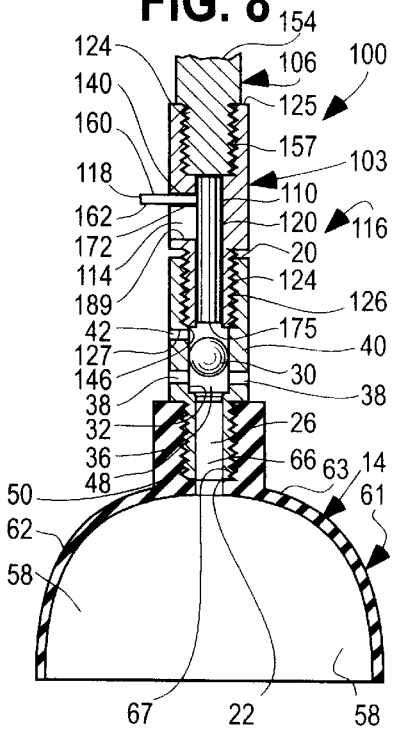
FIG. 8 is a sectional view of an alternative embodiment of the plunger device having a two piece housing.

Turning now to the FIG. 8 (also with reference to FIGS. 13 & 14), it will be seen that when the upper pin side 160 of the pin 118 abuts the bottom anvil surface 188 of the upper anvil 140, the valve ball 30 moves freely within the fluid discharge chamber 28, so that there is a fluid path from inside the clogged drain via the inside 58 of the cup 14 through the fluid inlet chamber 26 to the fluid pathway 24 and to the outside of the device 100 via the apertures 38. If the pin 118 is held against the upper anvil 140 and is forced to moved parallel to the surface of the upper anvil 140 toward the direction of the upper notch 172 and the upper containment area 194, with subsequent force, the pin 118 slips past the upper notch 172. This permits the pin 118 to enter the location formed by the upper containment area 194, and thus lock the pin 118 in place, which places the device into an open position allowing for the device 100 to function as a unidirectional plunger. Thus when the cup is compressed by pushing the handle 106 downward, fluid is effectively discharged through the fluid pathway 24 through apertures 38 avoiding a pressure build up in the drain.

Figure 9:
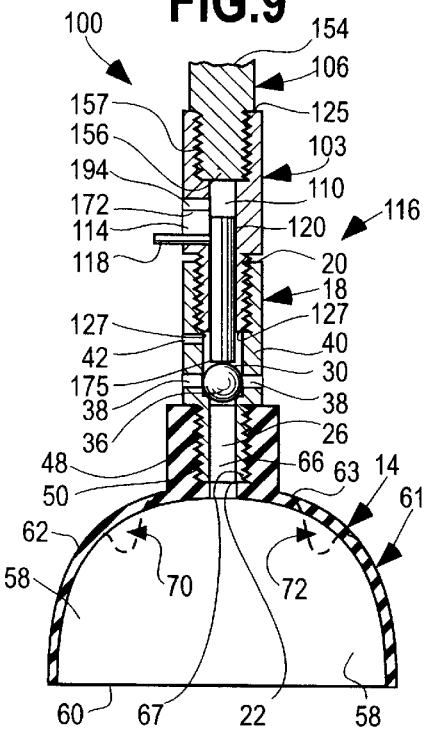
FIG. 9 is a similar sectional view as in FIG. 8 illustrating operation as a conventional plunger device.
Figure 10:
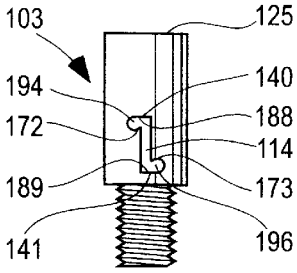
FIG. 10 is a side elevational view of an adapter housing for connecting a solid handle to the main housing and illustrating a substantially "Z" configuration for a channel guide to receive a pin and bolt locking mechanism.
Figure 11:
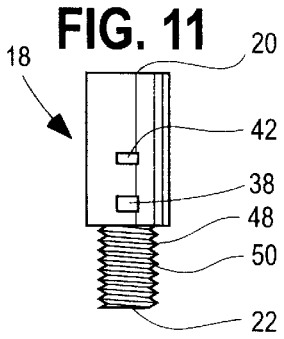
FIG. 11 is side elevational view of a housing displaying the discharge vent and orifice.
Figure 12:
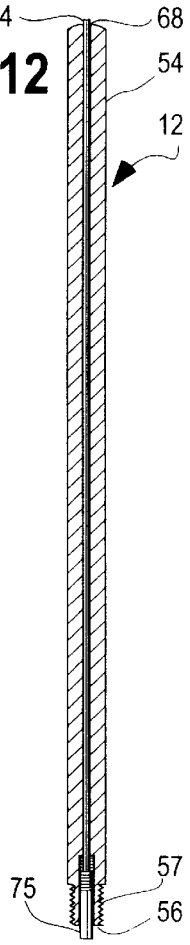
FIG. 12 is a sectional view of the handle of the plunger device illustrating a moveable threaded bolt.

As shown in FIG. 9, the pin 118 is forced down the pin guide channel 114 to the point where the lower pin side 162 of the pin 118 abuts the upper anvil surface 189 of the lower anvil 141 such that the bolt 120 moves freely down the bolt sliding cylinder 110 such that the bolt 120 vertically enters the discharge chamber 28.

The bottom edge 175 of the bolt 120 abuts the valve ball 30 and restrains it upon the valve seat 32 of the main housing to keep the device 100 in the closed position. In this configuration, the ball 30 is sandwiched between the valve seat 32 and the lower or bottom edge 175 of the bolt 120. If the pin 118 is held against the lower anvil 141 and is forced to moved parallel to the surface of the lower anvil 141 toward the direction of the lower notch 173 and the lower containment area 196, with subsequent force, the pin 118 slips past the lower notch 173 allowing the pin 118 to enter the location formed by the lower containment area 196. This locks the pin 118 in place and puts the device 100 into a closed position allowing the plunger to function as a conventional plunger device.

Figure 20:
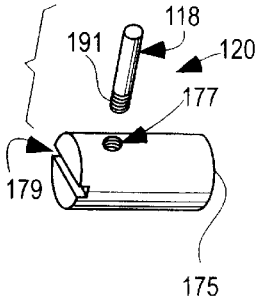
FIG. 20 is an enlarged prospective view of the pin and bolt.

When assembling the plunger 100, the bottom end 175 of the bolt 120 is inserted into the upper end 125 of the adapter housing 103 such that the bolt 120 enters the bolt sliding cylinder 110. The female coupling 177 (refer to FIG. 20) of the bolt 120 is aligned to the pin guide channel 114 (refer to FIGS. 13 & 14) by inserting a screwdriver tool into the alignment groove 179 and rotating. The pin 118 is then introduced into the bolt 120 via the pin guide channel 114 such that the male end 191 of the pin 118 is secured, by rotation if threaded, into the bolt 120.

The male screw connector 157 formed at the lower end 156 of the solid handle 106 is engaged with the female threading 124 of the upper end 125 of the assembled adapter housing 103. The valve ball 30 is inserted through the upper end 20 of the valve housing 18 and into the fluid discharge chamber 28. With the valve ball 30 in place, the male threading 126 of the bottom end 127 of the adapter housing 103 is engaged and secured into the female threading 44 in the upper end 20 of the valve housing 18. Thus, the valve ball 30 is confined between the adapter housing 103 and the valve housing 18.

The lower end 22 of the valve housing 18 is screwed into the neck 64 of the cup 14. The inside 58 of the cup 14 communicates with the inside of the valve housing 18 via the fluid pathway 24 in the open position.

Figure 7:
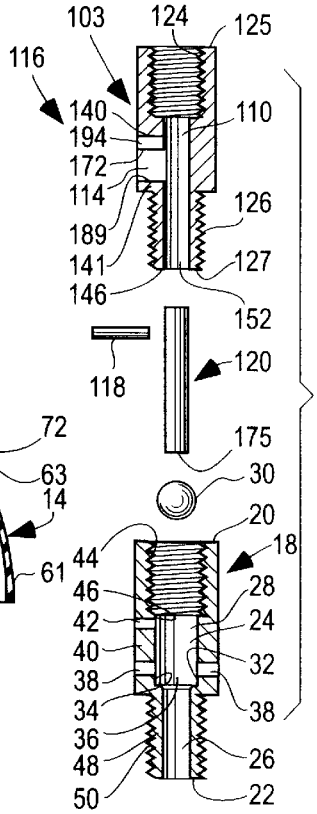
FIG. 7 is an exploded view of an alternative embodiment of the invention illustrating a two piece housing utilizing a pin and bolt arrangement.

Now referring to FIGS. 7 through 9, the operation of the plunger device 100 will be described. In FIG. 9, the valve ball 30 is shown restrained by the bolt 120 as preset by the user, which simultaneously closes the opening 36 of the seat 32 and the fluid discharge apertures 38 such that the device 100 functions thereby as a conventional plunger.

In FIG. 8, the valve ball 30 is shown spaced from the seat opening 36 and also spaced from the fluid discharge apertures 38 due to the changed user presetting of retraction of the bolt 120 via the movement of the pin 118 along the pin guide channel 114. This creates a fluid pathway from the inside 58 of the cup 14 and drain to the outside of the device 100 via the open discharge apertures 38. Upon collapsing of the cup 14, pressure is exerted on the valve ball 30 via the fluid flow from the inside 58 of the cup through the fluid inlet chamber 26 to the fluid inlet chamber 24. This forces the ball 30 to rest on the upper seat 146 of the adapter housing 103 preventing the fluid under pressure to pass through the opening 152 to the side of the bolt 120 in the bolt sliding cylinder 110, and subsequently out the pin guide channel 114. This permits the plunger device 100 to vent fluid to the outside via the fluid flow pathway 24 and out of the discharge apertures 38. Upon halting the motion of the device 100 by the user, the free floating valve ball 30 may relocate to the ball seat 32. The user can then reverse the direction of the device 100 to un-switch the device 100 to function in the opposite direction, which causes fluid under pressure to be forced or pulled out from the clogged drain.

To secure the ball 30 in place, the bottom edge 175 of the bolt 120 bears against the ball, and thereby prevents the ball from slipping or floating away. The bolt 120 of the plunger device 100 is relocated in one direction by sliding the pin 120 in the pin channel guide 114 to cause the bolt 120 to travel upwardly or downwardly. The pin 118 and bolt 120 arrangement function as a switch controlling the directional movement and operation of the device 100 by being locked in an open or closed position.

The plunger device 100 is placed upright in a sink, tub or toilet having a clogged pipe. The bolt 120 is preset by the user and retracted into the adapter housing 103 such that the lower most surface 175 of the bolt 120 is retracted with the adapter housing 103 exposing the adapter housing seat 146. The valve ball 30 is seated by gravity on the seat 32 to close the valve opening 36 and also to close the apertures 38 to prevent fluid flow from the inlet chamber 26 into the discharge chamber 28. This ball at rest position allows for a temporary closed position (as opposed to the set closed position as defined above) of the device 100.

The solid handle 106 is pushed downward to cause the cup 14 to depress and form the valley 70 between shoulder 62 and neck 64 (shown in phantom in FIG. 9). The depression of the cup 14 distorts the cup 14 and generates fluid under pressure to flow from the hollow inside 58 of the cup 14 and into the inlet chamber 26 of the valve housing 18. This permits the fluid to flow into the discharge chamber 28 for discharging the fluid to the outside of the plunger device 100 via discharge apertures 38, and prevents the fluid to flow into the bolt slide cylinder 110.

Therefore, the fluid under pressure moves the ball 30 off the seat 32, and in effect, switches the device 100 from a closed position to an open position. The ball is free to move further into the discharge chamber 28 and is not subject to any substantial pressure build up in the discharge chamber 28 because the upper portion of the discharge chamber 28 has a discharge vent 42, which does not allow for any pressure build up in the discharge chamber 28.

Next the cup 14 is depressed and a suction is created. The lip 60 of the cup 14 is tightly puckered on the surface of the sink surrounding the clogged pipe. After the fluid pressure dissipates, the valve ball 30 drifts downward due to gravity, to seat on the valve seat 32 and close the opening 36. This also closes the fluid discharge apertures 38.

When the ball 30 seats due to the gravity and the cup 14 is distorted, the handle 106 is pulled upward to return the cup 14 to its original and normal shape (which is larger than the distorted configuration of the cup 14 after the cup 14 is pushed inward). A vacuum is immediately created inside the cup 14, and fluid under pressure rushes from inside the clogged pipe to the inside of the expanded cup 14 to fill the vacuum. Fluid under pressure is also generated inside the discharge chamber 28 which bears against the seated ball 30 to tightly close the device 100. The fluid streaming into the cup from the clogged pipe, suctions the clogged material outward and out of the pipe to clear the pipe. The end of this action completes one cycle of operation, and the user will find the device 100 in a temporary closed position with the cup 14 in an un-distorted position such as when the device was initially placed in the sink.

The firm contact of the lip 60 of the cup 14 with the surface surrounding the inlet into the clogged pipe does not require resetting of the cup after pulling the cup upwardly.

In view of the foregoing, it is seen that a single device 100 is utilized to provide dual directional action to create a unidirectional suction for unblocking a clogged drain pipe.

If the clogged pipe is not sufficiently cleared, the user of the plunger device 100 repeats the aforedescribed sequence of pushing and pulling of the fluid in the drain pipe until the pipe is freed of the clogging material.

An alternate embodiment and its operation is now described. Referring now to FIGS. 15 through 20 of the drawings, the reference numeral 200 generally indicates a plunger device. The plunger device 200 includes an elongated solid handle 106, a flexible, inverted cup 14, and a fluid control valve 216, which is composed of a valve housing 218, interposed between the solid handle 106 and cup 14.

The fluid control valve 216 includes a valve housing 218 having an upper end 220 and a lower end 222. A fluid pathway 24 extends centrally in the housing 218, for discharging fluid to the outside. The valve housing 218 includes a centrally bored bolt sliding cylinder 110 and a pin guide channel 114, a vent orifice 42, a discharge aperture 38, a valve seat 32, a fluid discharge chamber 28, a fluid inlet chamber 26, an upper end 220 and a lower end 222.

The valve housing 218 includes a tubular fluid inlet chamber 26 and a cylindrical fluid discharge chamber 28. A valve ball 30 is positioned inside the discharge chamber 28. The cross sectional area perpendicular to the longitudinal center of the housing 218 is greater for the fluid discharge chamber 28 than for the fluid inlet chamber 26.

The valve housing 218 of the fluid control valve 216 further comprises a valve seat 32 formed between the inlet fluid chamber 26 and the discharge fluid chamber 28. The valve seat 32 includes an outer ring or ledge 34 encircling and opening 36 between the inlet chamber 26 the discharge chamber 28. The opening 36 communicates the inlet chamber 26 with the discharge chamber 28. The opening 36 is covered (or closed) when the valve ball 30 is seated on the valve seat 32. Hence, the fluid control valve 216 includes the opening 36 having an open position when the valve ball 30 is spaced from the seat 32; and a closed position to block fluid flow to the outside of the device 200 when the ball 30 is seated on the seat 32.

The diameter of the valve ball 30 is greater than the diameter of the opening 36 of the seat 32. The ball 30 is seated on the seat 32 on the ledge 34 to close the opening 36 of seat 32 and prevent fluid flow between the inlet chamber 26 and the discharge chamber 28.

One or more spaced apart apertures 38 are formed through the cylindrical wall 140 of the discharge chamber 28. The apertures 38 function as fluid discharge outlets to the outside of the plunger device 200 when the valve ball 30 is spaced from the valve seat 32. Fluid flowing from the inlet chamber 26 to the apertures 38 is blocked by the valve ball 30 when the valve ball 30 is spaced from the valve seat 32. Fluid flowing from the inlet chamber 26 to the apertures 38 is blocked by the valve ball 30 when the valve ball 30 is positioned on the seat 32. Moreover, the apertures 38 are closed by the valve ball 30 when the ball 30 is reoriented on the seat 32.

An orifice 42 is also formed in the wall 140 of the discharge chamber 28, spaced upward or outward from the apertures 38. More than one orifice 42 may be formed in the wall 140. Fluid flows from the outside of the device 200 and into the discharge chamber 28 via the orifice 42 when the valve ball 30 is positioned on the seat 32 to maintain the ball 30 on the seat 32.

When the valve ball 30 is spaced outward from the valve seat 32, the fluid pathway 24 is opened to the outside via the apertures 38; and the fluid pathway is closed to the outside when the ball 30 is positioned on the seat 32. The fluid pathway 24 to the outside via the orifice 42 may be blocked by the valve ball 30, when the ball is spaced from the seat 32.

The valve housing 218 enables the plunger device 200 to be used in a pin 118 and bolt 120 arrangement. The valve housing 218 has an upper end 220 and a lower end 222.

A bolt 120 is position inside the bolt sliding cylinder 110. The bolt 120 is secured in place with a pin 118 that is in contact with the bolt 120 via the pin guide channel 114. The valve housing 218 includes a pin channel guide 114 which is composed of an upper securing notch 172, a lower securing notch 173, an upper pin containment area 194, a lower pin containment area 196 upper anvil 140 spaced from a lower anvil 141 and linked together by means of the pin guide channel 114.

A pin guide channel 114 is formed through the wall 140 of the valve housing 218. A pin 118 has a smaller diameter than the pin guide channel 114 such that the pin 118 can freely move in the pin guide channel 114. The axis of the pin 118 is oriented perpendicular to the pin channel guide 114 and the said pin 118 can freely move in a parallel direction to the pin guide channel 114. A pin 118 has a smaller diameter than the upper containment area 194 and the lower containment area 196 such that the pin can be confined to the area provided. The pin 118 has a larger if not equal diameter to the distance between the upper securing notch 172 and the upper anvil 140 such that the pin stays locked in the upper containment area 194. The pin 118 has a larger if not equal diameter to the distance between the lower securing notch 173 and the lower anvil 141 such that the pin stays locked in the lower containment area 196.

The cooperation of the pin 118 and bolt 120, as set within the bolt sliding cylinder 110 and the pin channel guide 114, provides a switch for operating either as a single or dual directional plunger.

The solid handle 106 includes an upper grip end 154 and a lower end 156. The lower end 156 of the solid handle 106 includes a male screw connector 157 on the solid handle surface 158.

The valve housing 218 includes a female connector 124 formed in the inside surface 246 of the wall 140 at the upper end 220 and a male connector 48 on the surface 223 at the lower end 222. The female connector 124 of the valve housing 218 threadedly engages with the male connector 157 formed in the lower end 156 of the solid handle 106. An internal female screw connector 67 is formed inside the channel 66 of the neck 64 to threadedly engage the male connector 48 of the valve housing 218.

Figure 13:
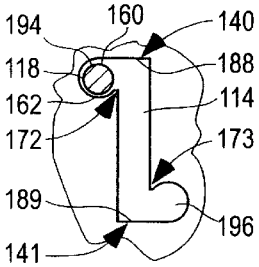
FIG. 13 is a side elevational view of the "Z-like" configuration channel guide containing a pin locked in the upper containment section of the channel guide.
Figure 14:
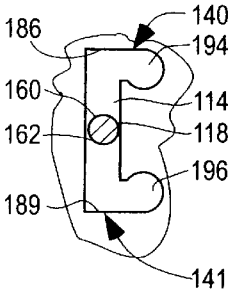
FIG. 14 is a side elevational view of an alternate embodiment of a "C-like" channel guide containing a pin located in the vertical window section of the channel guide.
Figure 19:
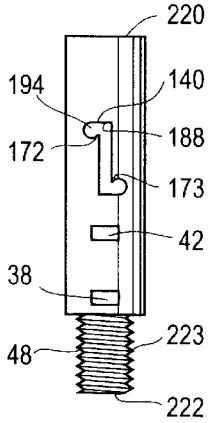
FIG. 19 is a side elevational view of the unified housing for connecting a solid handle to the main housing and illustrating a "Z-like" configuration for a channel guide.

Turning now to the FIGS. 13, 14 and 19, it will be seen that when the upper pin side 160 of the pin 118 abuts the bottom anvil surface 188 of the upper anvil 140, the valve ball 30 moves freely within the fluid discharge chamber 28, so that there is a fluid path from inside the clogged drain to the outside of the device 200 via the apertures 38. Thus, when the cup is compressed by pushing the handle 106 downward, fluid is effectively discharged through the fluid pathway 24 through apertures 38 avoiding pressure build up in the drain. If the pin 118 is held against the upper anvil 140 and is moved parallel to the surface of the upper anvil 140 toward the direction of the upper notch 172 and the upper containment area 194, with subsequent force, the pin 118 slips past the upper notch 172 allowing the pin 118 to enter the location formed by the upper containment area 194. This locks the pin 118 in place and puts the device into an open position allowing for the device 200 to function as a unidirectional plunger device. The pin guide channel 114 may have a "Z" configuration, as shown in FIG. 13 or a "C" configuration, as shown in FIG. 14.

Figure 15:
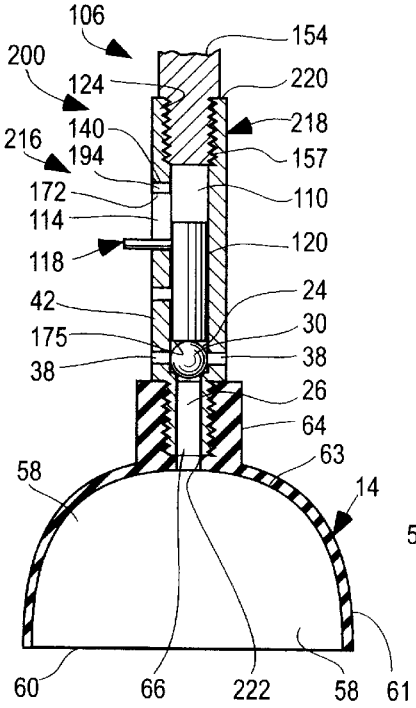
FIG. 15 is a sectional view of an alternative embodiment of the plunger device in a unified housing package.

As shown in FIG. 15, the pin 118 is forced down the pin guide channel 114 to the point where the lower pin side 162 of the pin 118 abuts the upper anvil surface 189 of the lower anvil 141 such that the bolt 120 moves freely down the bolt sliding cylinder 110 such that the bolt 120 vertically enters the discharge chamber 28. The bottom edge 175 of the bolt 120 abuts the valve ball 30 and restrains it upon the valve seat 32 of the main housing to keep the device 200 in the closed position. In this configuration, the ball 30 is sandwiched between the valve seat 32 and the lower or bottom edge 175 of the bolt 120. If the pin 118 is held against the lower anvil 141 and is forced to moved parallel to the surface of the lower anvil 141 toward the direction of the lower notch 173 and the lower containment area 196. With subsequent force, the pin 118 slips past the lower notch 173 allowing the pin 118 to enter the location formed by the lower containment area 196. This locks the pin 118 in place and puts the device 200 into a closed position.

When assembling the plunger 200, the valve ball 30 is inserted through the upper end 220 of the valve housing 218 and into the fluid discharge chamber 28 through the bolt sliding cylinder 110. The bottom end 175 of the bolt 120 is inserted into the upper end 220 of the main housing 218 such that the bolt 120 enters the bolt sliding cylinder 110. The female coupling 177 is aligned to the pin guide channel 114 by inserting a screwdriver tool into the alignment groove 179 and rotating. The pin 118 is then introduced into the bolt 120 via the pin guide channel 114 such that the male end 191 of the pin 118 is secured, by rotation if threaded, into the bolt 120.

The male screw connector 157 formed at the lower end 156 of the solid handle 106 is engaged with the female threading 124 of the upper end 220 of the main housing 218. With the valve ball 30 in place, the male threading 48 of the bottom end 222 of the main valve housing 218 is engaged and secured into the neck 64 of the cup 14. Thus, the valve ball 30 is confined between the bolt 120 and the seat 32.

The inside 58 of the cup 14 communicates with the inside of the valve housing 218 via the fluid pathway 24 in the open position. Moreover, the fluid discharge apertures 38 are closed when the valve ball 30 is locked in place, as shown in FIG. 15.

Figure 16:
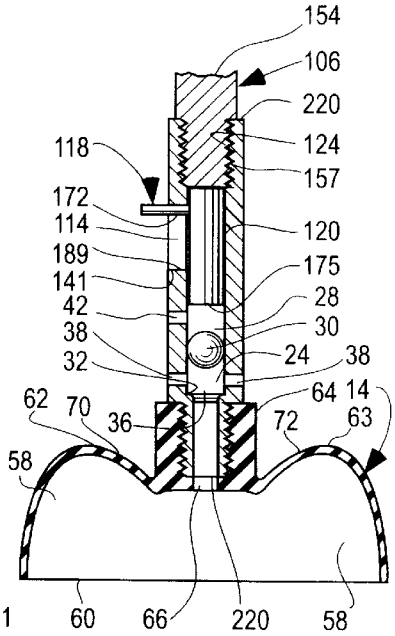
FIG. 16 is a sectional view illustrating the location of parts when the device is used as a conventional plunger device.
Figure 17:
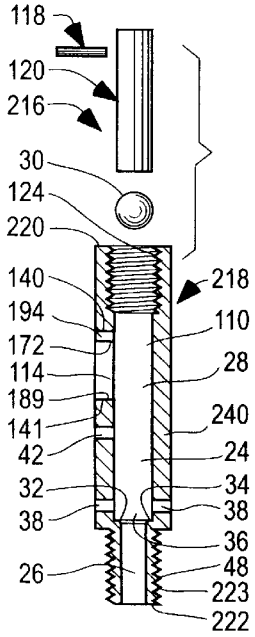
FIG. 17 is an exploded view of the unified housing utilizing a pin and bolt arrangement in a unified housing package.
Figure 18:
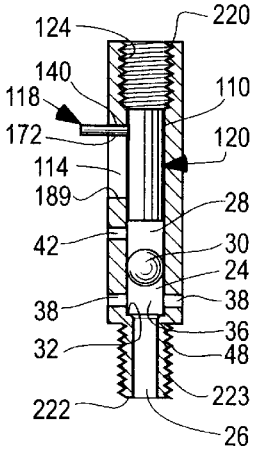
FIG. 18 is a sectional view of the assembled valve housing with pin, bolt and ball.

Turning now to FIGS. 15, 16, the operation of the plunger device 200 will be described. In FIG. 15, the valve ball 30, shown restrained by the bolt 120 as preset by the user, simultaneously closes the opening 36 of the seat 32 and the fluid discharge apertures 38 such that the device 200 functions as a conventional plunger to free a clogged drain. The direction of the fluid flow may be reversed by pulling the handle to cause the impurities to be pulled out from the clogged drain. This creates a bidirectional fluid flow in the drain.

In FIG. 16, the valve ball 30 is shown spaced from the seat opening 36 and also spaced from the fluid discharge apertures 38 due to the changed user presetting of retraction of the bolt 120. This creates a fluid pathway from the inside 58 of the cup 14 and drain to the outside of the device 200 via the open discharge apertures 38. Upon collapsing of the cup 14, pressure is exerted on the valve ball 30 and forces it to abut the lower surface 175 of the bolt 120. This permits the plunger device 200 to vent fluid to the outside via the fluid flow pathway 24 and out the discharge apertures 38. Upon further motion by the user, the free floating valve ball 30 may relocate to the ball seat 32 to switch the device 200 to function in the opposite direction, to cause fluid under pressure to be forced or pulled out from the clogged drain.

To secure the ball 30 in place, the bottom edge 175 of the bolt 120 bears against the ball, and thereby prevents the ball from slipping or floating away.

The bolt 120 of the plunger device 200 is relocated in one direction by sliding the pin 120 in the pin channel guide 114 to cause the bolt 120 to travel upwardly or downwardly. The pin 118 and bolt 120 arrangement functions as a switch controlling the directional movement and operation of the device 200 by being locked in an open or closed position as understood.

The plunger device 200 is placed upright in a sink or tub having a clogged pipe(s). The bolt 120 is preset by the user to the open position by relocating pin 118 to the upper containment area 194. The valve ball 30 is seated by gravity on the seat 32 to momentarily close the valve opening 36 and also to close the apertures 38 and prevent fluid flow from the inlet chamber 26 and into the discharge chamber 28. This ball at rest situation allows for a temporary closed position (as opposed to the set closed position as defined above) of the device 200.

The solid handle 106 is pushed downward to cause the cup 14 to depress and form a valley 70 between shoulder 62 and neck 64. The depression of the cup 14 distorts the cup 14 and generates fluid under pressure to flow from the hollow inside 58 of the cup 14 and into the inlet chamber 26 of the valve housing 218, to force the valve ball 30 off the seat 32 upward to abut the ball 30 on the lower surface 175 of the bolt 120. This enables the fluid to flow into the discharge chamber 28 for discharging the fluid to the outside of the plunger device 200 via discharge apertures.

Therefore, the fluid under pressure moves the ball 30 off the seat 32, and in effect, switches the device 200 from a closed position to an open position. The ball is free to move further into the discharge chamber 28 and is not subject to any capillary build of pressure in the discharge chamber 28 since the upper portion of the discharge chamber 28 has a discharge vent orifice 42, which does not permit pressure build up in the discharge chamber 28 due to the motion of the ball away from the valve opening 36.

After the cup 14 is depressed, a suction is created and the lip 60 of the cup 14 is tightly puckered on the surface of the sink surrounding the clogged pipe. After the fluid pressure dissipates, the valve ball 30 drifts downward due to gravity, to seat on the valve seat 32 and close the opening 36, and also to close the fluid discharge apertures 38. When the ball 30 seats due to the gravity and the cup 14 is distorted, the handle 106 is pulled upward to return the cup 14 to it's original and normal shape. A vacuum is immediately created inside the cup 14, and fluid under pressure rushes from inside the clogged pipe to the inside of the expanded cup 14 to fill the vacuum. Fluid under pressure is also generated inside the discharge chamber 28 which bears against the seated ball 30 to tightly close the device 200. The fluid streaming into the cup from the clogged pipe, suctions the clogged material outward and out of the pipe to clear the pipe. The end of this action completes one cycle of operation and the user will find the device 200 in a temporary closed position with the cup 14 in an un-distorted fashion such as when the device was initially placed in the sink. The firm contact of the lip 60 of the cup 14 with the surface surrounding the inlet into the clogged pipe, normally would not require resetting of the cup, after pulling the cup upwardly.

In view of the foregoing, it is seen that a single device 200 is utilized to provide simple dual directional action to create a unidirectional suction for unblocking a clogged drain pipe. If the clogged pipe is not sufficiently cleared, the user of the plunger device 200 repeats the aforedescribed sequence of pushing and pulling of the fluid in the drain pipe, until the pipe is freed of the clogging material.

Specific embodiments of a Dual-Acting Plunger according to the present invention have been described for the purpose of illustrating the manner in which the invention may be made and used. It should be understood that implementation of other variations and modifications of the invention and its various aspects will be apparent to those skilled in the art, and that the invention is not limited by the specific embodiments described. It is therefore contemplated to cover by the present invention any and all modifications, variations, or equivalents that fall within the true spirit and scope of the basic underlying principles disclosed and claimed herein.

What is claimed is:

1. A plunger for clearing clogging material from a drainage pipe, the pipe having a fluid inlet, the plunger comprising:

a flexible, hollow inverted cup having an open end for contacting the fluid inlet, the cup defining a cup chamber;

an elongated handle configured to transmit force to the cup to cause the cup to distort;

a valve housing assembly operatively coupled between the cup and the handle;

the valve assembly having a pathway configured to permit fluid communication between the cup chamber and an external environment, and a valve disposed within the pathway for blocking the pathway; and a valve position controller configured to releasably retain the valve in a blocking position to block the pathway to prevent said fluid communication.

2. A plunger for clearing a drainage pipe, the pipe having a fluid inlet surrounded by a contact surface, the plunger comprising:

a deformable, hollow inverted cup defining a cup chamber, the cup configured to reciprocally deform from a normal shape to a deformed shape have a reduced volume;

a valve assembly operatively connected to the cup;

the valve assembly including a pathway within the valve assembly configured to permit fluid to flow between the cup chamber and an external environment;

the valve assembly including a valve disposed within the pathway configured to releasably block the pathway to prevent said fluid flow when placed in a blocking position;

a valve blocking controller configured to releasably retain the valve in a blocking position to block the pathway to prevent said fluid communication;

wherein when the valve is in the blocking position, deformation of the cup from the normal shape to the deformed shape creates a fluid flow under pressure from the cup chamber into the pipe; and wherein when the valve in not in the blocking position, deformation of the cup from the normal shape to the deformed shape permits fluid flow from the cup chamber to the external environment while deformation of the cup from the deformed shape to the normal shape creates a fluid flow under suction from the pipe into the cup chamber.

3. A plunger for clearing clogging material from a drainage pipe, the pipe having a fluid inlet surrounded by a contact surface, the plunger comprising:

a flexible, hollow inverted cup having an open end for contacting the contact surface, the cup forming a cup chamber therewithin;

an elongated handle configured to transmit force to the cup to cause the cup to distort;

a valve housing assembly operatively disposed between the cup and the handle;

the valve housing assembly including a pathway within the valve assembly configured to permit fluid communication between the cup chamber and an external environment, and a valve disposed within the pathway for blocking the pathway;

a valve position controller configured to releasably retain the valve in a blocking position to block the pathway to prevent said fluid communication;

wherein when the controller retains the valve in the blocking position, application of downward force on the handle creates a fluid flow under pressure from the cup chamber into the fluid inlet; and wherein when the controller does not retain the valve in the blocking position, application of downward force on the handle permits fluid flow from the cup chamber to the external environment, while application of upward force on the handle creates a fluid flow under suction from the fluid inlet into the cup chamber.

4. The plunger according to claim 3 wherein the valve housing assembly includes a valve seat and the valve is a ball configured to sealingly abut the valve seat.

5. The plunger according to claim 3 wherein the valve housing assembly includes a valve seat and the valve is a check valve configured to sealingly abut the valve seat.

6. The plunger according to claim 3 wherein the valve housing assembly includes at least one aperture formed therein to permit the fluid communication between the cup chamber and an external environment when the valve is not retained in the blocking position.

7. The plunger according to claim 3 wherein the valve housing assembly includes a bore formed therein, the bore configured to receive a shaft, wherein the shaft is configured to contact a portion of the valve and releasably retain the valve in the blocking position.

8. The plunger according to claim 7 wherein the shaft slidingly moves within the bore.

9. The plunger according to claim 7 wherein the shaft has a threaded portion and is configured to move within the bore upon rotation of the shaft.

10. The plunger according to claim 7 wherein the shaft is rotatable within the bore so as to move along a longitudinal axis of the bore when rotated.

11. The plunger according to claim 7 wherein the shaft is configured to releasably lock in a first position of the valve to retain the valve in the blocking position.

12. The plunger according to claim 7 further including means for releasably securing the valve in the blocking position.

13. The plunger according to claim 7 further including locking means for releasably fixing the shaft in a first position such that the shaft contacts a portion of the valve to retain the valve in the blocking position.

* * * * *